US005975885A

United States Patent [19]

Rajewski

[11] Patent Number: 5,975,885

[45] Date of Patent: Nov. 2, 1999

[54] FLARE STACK

[75] Inventor: Robert Carl Rajewski, Donalda, Canada

[73] Assignee: Tornado Flare Systems, Inc., Alleyton, Tex.

[21] Appl. No.: 09/136,900

[22] Filed: Aug. 19, 1998

[51] Int. Cl.[6] ..... F23D 11/00

[52] U.S. Cl. ..... 431/89; 431/202

[58] Field of Search ..... 431/202, 89

[56] References Cited

U.S. PATENT DOCUMENTS 4,336,017 6/1982 Desty .
4,464,110 8/1984 Boden et al. .
4,634,372 1/1987 Allum et al. .
4,800,690 1/1989 Bunce .

*Primary Examiner*—Carroll Dority
*Attorney, Agent, or Firm*—Christensen O'Connor; Johnson & Kindness PLLC

[57] ABSTRACT

A flare stack with increased control of flow velocity of gases. The flare stack includes a pipe having a flare tip. The flare tip is provided with orifices and a sliding sleeve that opens and closes at least some of the orifices under control of an actuator. The actuator is pressure controlled. Nozzles extend from the orifices, parallel to each other. A central nozzle produces a stabilized flame. The nozzles which are controlled by the sliding sleeve are arranged in rings axially offset from each other along the pipe, so that the sleeve may open or close the nozzles in a ring as desired. The nozzles are symmetrically disposed, and terminate at the same plane, with the nozzles being disposed sufficiently close to each other that gas exiting any nozzle tends to draw in and merge with gas exiting from any adjacent nozzle.

11 Claims, 2 Drawing Sheets

FLARE STACK

FIELD OF THE INVENTION

This invention relates to devices used for the flaring of gas.

BACKGROUND OF THE INVENTION

It is frequently necessary to burn gas at oil and gas installations. The gas is typically directed to a vertically standing pipe or flare stack. Gas exiting the top of the pipe is ignited with an igniter. It is important that the gas be kept burning. With high winds, the flame can easily be blown out. As a result, high gas flow rates may be required to keep the flame alive. As pressure varies within the flare stack, the flow rate of gas may vary. When the flow rate is low, the flame is more easily blown out. Kaldair of Houston, Tex., has provided a device which uses the Coanda effect and a pot valve to variably control the flow of gas from the flare stack in response to variation of pressure within the stack. While this device has had commercial success, the inventor has provided an improvement upon it.

SUMMARY OF THE INVENTION

In accordance with a broad aspect of the invention, there is provided a flare stack with increased control of flow velocity of gases. The flare stack includes a pipe having a flare tip. The flare tip is provided with orifices and a sliding sleeve that opens and closes at least some of the orifices under control of an actuator. The actuator is preferably pressure controlled. Preferably, nozzles extend from the orifices, parallel to each other. A central nozzle preferably produces a stabilized flame. The nozzles which are controlled by the sliding sleeve are preferably arranged in rings axially offset from each other along the pipe, so that the sleeve may open or close the nozzles in a ring as desired. The nozzles are preferably symmetrically disposed, and terminate at the same plane, with the nozzles being disposed sufficiently close to each other that gas exiting any nozzle tends to draw in and merge with gas exiting from any adjacent nozzle.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

Figure 1:
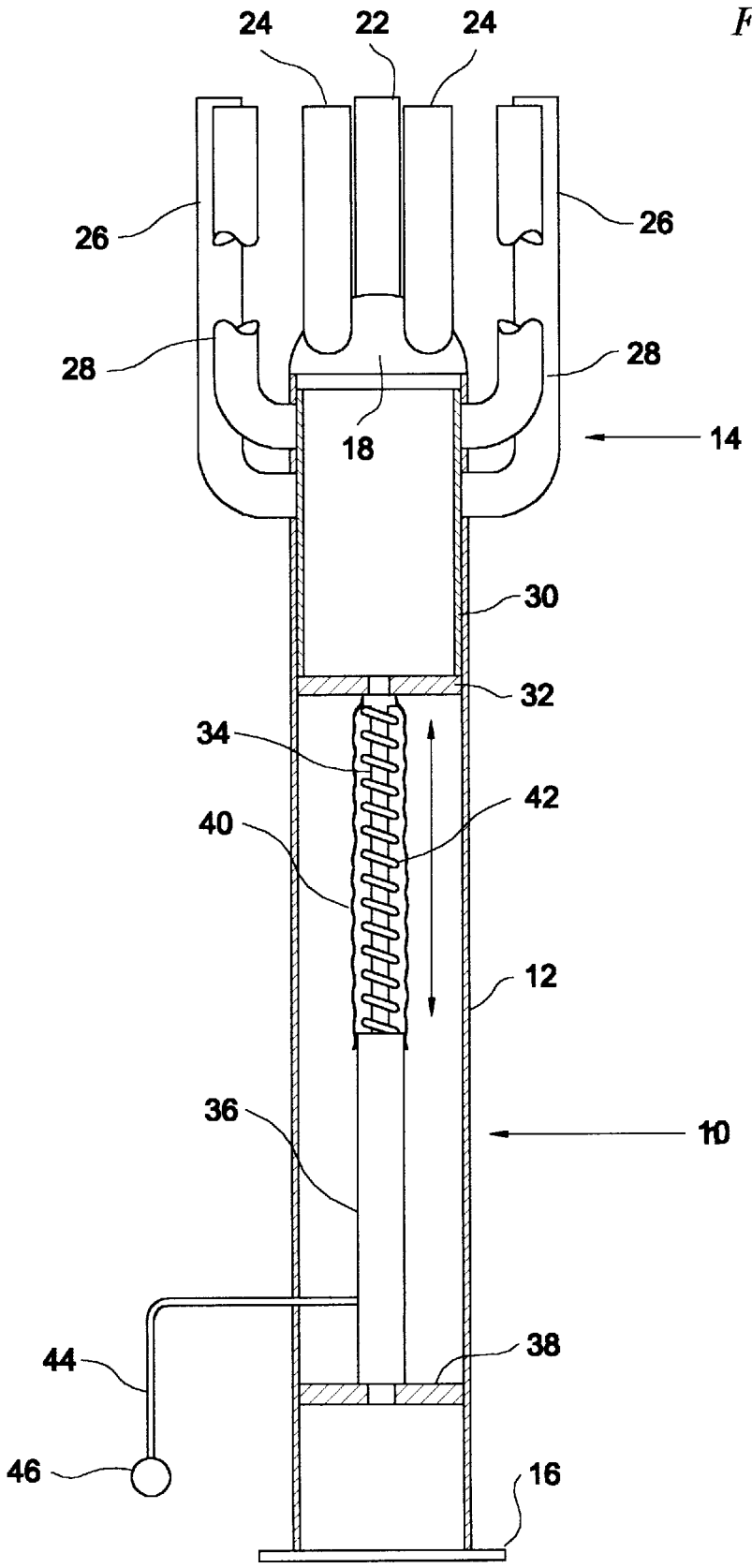
FIG. 1 is a side section of a flare stack with controlled flow velocity according to the invention.
Figure 2:
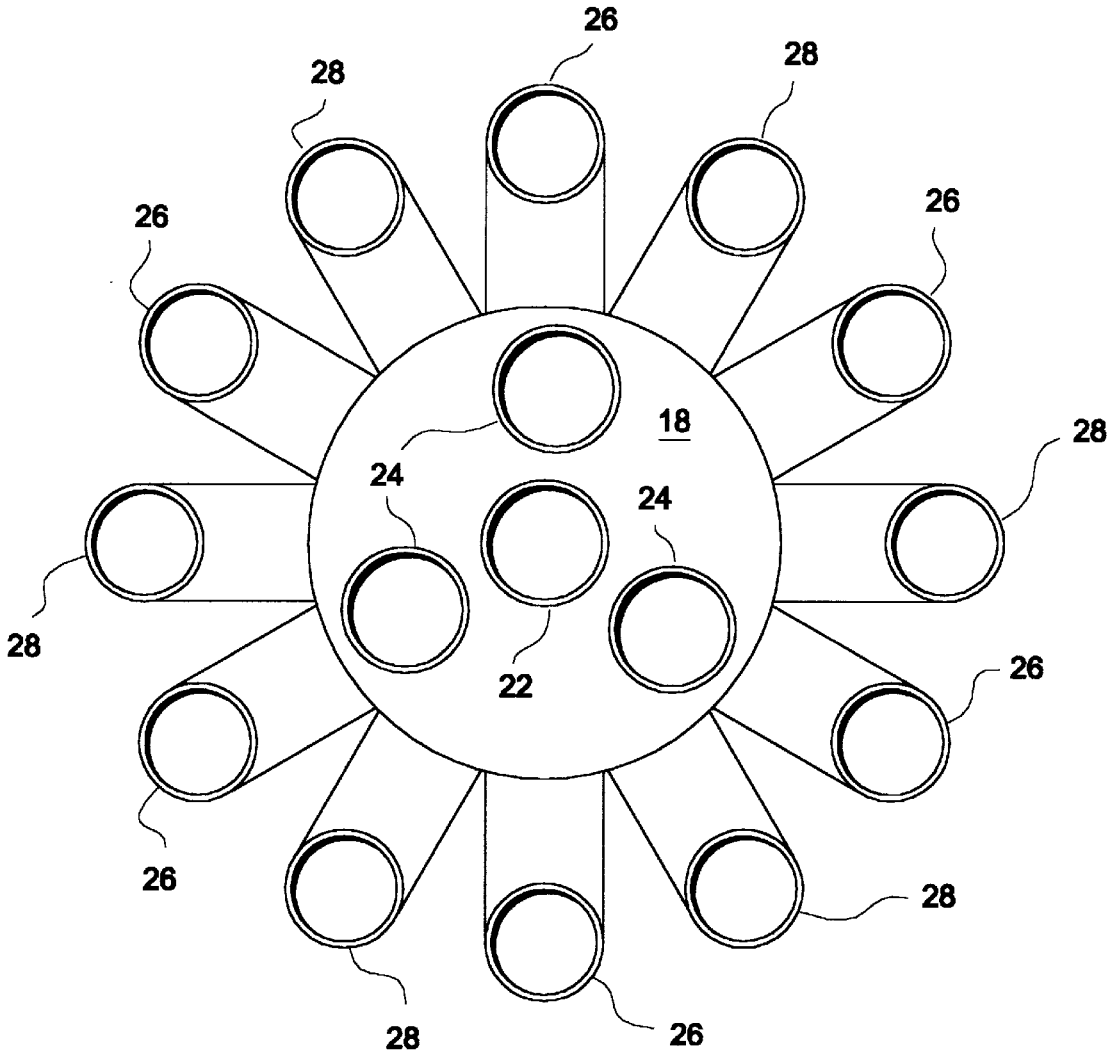
FIG. 2 is a top view of the flare stack of FIG. 1.

Referring to FIGS. 1 and 2, a flare stack 10 is formed of a pipe 12 terminating upward in use in a flare tip 14. The pipe 12 may be 24 inch STD wall 304 SS pipe 10 feet long. A flange 16, which may be a 24 inch #150 RFSO (raised face slip on) CS flange, is secured as by welding to the base of the pipe 12. The flange 16 is typically bolted to pipes forming the balance of a conventional flare stack, as for example in a refinery.

The pipe 12 terminates at the flare tip 14 in a cap 18, for example a 24 inch STD wall 304 SS cap. The tip 14 is defined here as the portion of the flare stack from which gas is ejected for burning. The cap 18 forms part of the tip 14. A portion of the end of the cylindrical pipe 12 also in this embodiment forms part of the flare tip 14. A central nozzle 22 extends from an orifice at the apex of the cap 18. The nozzle 22 may be an 8 inch STD wall 310 SS pipe with a conventional flare stabilizer and gas stripper. The central nozzle 22 in use has a constant flame burning, and is ignited by a pilot, not shown, many of which are known in the art, such as described in U.S. Pat. No. 5,749,719. The inventor prefers to use a silicon nitride gas pilot having the basic design shown in U.S. Pat. No. 5,749,719, but using a flash tube for the ignition system, and with the retainer members for the silicon nitride nozzle being encased within the silica nitride to protect them from corrosion. Nozzle 22 should be designed to operate at 0.5 mach to ensure a constant stable high volume flame burns. The nozzle 22 should have a length that brings it to about 5 feet from the surface of cap 18.

Nozzle 22 is surrounded by three equally spaced nozzles 24 extending from orifices in the cap 18. The nozzles 24 are preferably parallel to nozzle 22 and symmetrically disposed around nozzle 22. The nozzles 24 preferably terminate in the same plane, perpendicular to the flare stack, as the nozzle 22. The nozzles 24 may be 8 inch STD 310 SS pipes, and are preferably operated fully open at 1 mach. Combined flows of nozzles 22 and 24 may be for example 75,000,000 scfd, with tip pressure at from 11 to 15 psi.

Surrounding nozzles 24 and extending initially radially and then axially from circumferentially spaced orifices in the tip end of pipe 12 are several, eg six J-shaped, nozzles 26 forming a ring of nozzles. These nozzles 26 may be 6 inch STD wall 310 SS pipes, which are fully open. As will be described below, the orifices in pipe 12 leading to the nozzles 26 may be opened to varying degrees with a sliding sleeve 30.

A second ring of nozzles 28 is disposed around the pipe 12 axially offset from and just below nozzles 26. The nozzles 28 extend initially radially and then axially from circumferentially spaced orifices in the tip end of pipe 12 are several, eg six J-shaped, nozzles 28. These nozzles 28 may be 6 inch STD wall 310 SS pipes, which are fully open. As will be described below, the orifices in pipe 12 leading to the nozzles 28 may be closed and opened to varying degrees with a sliding sleeve 30.

The nozzles 26 and 28 in combination may deliver at total flow of 350,000,000 scfd at a feeder pressure of 15 psi.

Flow to the nozzles 26 and 28 is controlled by sleeve 30. Sleeve 30 is a cylinder, for example made of 304 SS, whose outer diameter closely matches than the inner diameter of pipe 12, with sufficient clearance to allow sliding of sleeve 30 in pipe 12. The sleeve 30 has a solid exterior wall which may slide past and block the orifices leading to the nozzles 26 and 28. Sleeve 30 has a base 32, which is open for the flow of gas into the sleeve 30, which is connected by an actuator rod 34 to a hydraulic cylinder 36. The hydraulic cylinder 36 and actuator rod 34 together form an actuator for the sleeve 30. Hydraulic cylinder 36 is supported in the pipe 12 on support 38. A flexible cover 40 may be used to protect the actuator rod 34 in conventional fashion. A spring 42 concentrically disposed around the rod 34 biases the rod 34 in the fully extended position with the sleeve 30 covering the orifices leading to the nozzles 26 and 28.

A supply of hydraulic fluid is provided to cylinder 36 through tubing 44. The hydraulic fluid flow to the cylinder 36 is controlled by a hydraulic control system 46. Any of various hydraulic control systems may be used. For example, the hydraulic control system may comprise a pressure transmitter, controller and hydraulic control valve. The controller may be set to a pressure of for example 15 psi, which may correspond to an output signal from the controller of 10 milliamps. The pressure transmitter feeds the pressure to the controller, which in turn sends its electrical control output to the valve. The valve may be set to open in proportion to the signal that it receives. Thus, as the pressure in the pipe 12 increases, the valve opens more, driving hydraulic fluid into the hydraulic cylinder 36. As fluid is supplied to hydraulic cylinder 36, actuator rod 34 is drawn into the cylinder, pulling sleeve 30 away from the orifices leading to nozzles 26 and 28, thus opening the nozzles. Hence, as the pressure in the pipe 12 increases, the nozzles 26 and 28 open more. A manual override may be provided for the hydraulic system so that the sleeve can be forced to a desired position.

In operation, idle flow to the flare tip is up to about 75,000,000 scfd per day. This flow exits through nozzles 22 and 24 in the idle state, with one of the nozzles, preferably the central nozzle, operating in a stable condition, as for example may be provided by operating at 0.5 mach with a flame stabilizer and flame stripper. The high velocity gas flows provided by the nozzles 24 draws burning gas from the stable flame from nozzle 22 and keeps the gas burning from the nozzles 24. As gas flow increases, the sleeve 30 moves axially and delivers gas from the inside of the pipe 12 to the nozzles 26. High velocity gas existing nozzles 24 draws the gas from nozzles 26 and keeps it burning. Likewise, as the pressure further increases, the next ring of nozzles 28 gradually opens and the gas is drawn by high velocity gas exiting nozzles 26 and kept burning. Two exemplary rings of controlled aperture nozzles 26, 28 are shown, but additional rings may be used.

In addition, although nozzles terminating in a plane perpendicular to the axis of the pipe 12 are preferred, it is possible in an embodiment of the invention to have nozzles that extend variable distances from the flare tip, or that may consist only of openings in the flare tip. In addition, the flare tip, according to one embodiment, may be formed of an outer spherical shell, with orifices in the outer shell disposed preferably in a symmetrical pattern, and an inner spherical shell with a further set of orifices. The orifices of the two shells should be arranged so that movement of one shell in side the other makes different numbers of the orifices coincide, thus varying the volumetric flow rate from the flare tip, while maintaining high velocity of the gas from the flare tip.

A person skilled in the art could make immaterial modifications to the invention described in this patent document without departing from the essence of the invention that is intended to be covered by the scope of the claims that follow.

The embodiments of the invention in which an exclusive property or privilege is claimed are defined as follows:

1. A flare stack comprising:

a pipe terminating in a flare tip;

the flare tip having a plurality of orifices disposed around the flare tip;

a sliding sleeve disposed adjacent at least some of the orifices and operable to open and close the orifices; and an actuator connected to the sliding sleeve for moving the sliding sleeve.

2. The flare stack of claim 1 in which the actuator is operable in response to pressure in the flare stack such that greater pressure in the flare stack results in more open orifices.

3. The flare stack of claim 2 further comprising nozzles extending from the orifices.

4. The flare stack of claim 3 in which the nozzles extend parallel to each other.

5. The flare stack of claim 4 in which the nozzles comprise a central nozzle surrounded by plural nozzles spaced equally from the central nozzle.

6. The flare stack of claim 5 in which the central nozzle provides, in operation, a stabilized flame in relation to flame produced from the plural nozzles.

7. The flare stack of claim 3 in which the nozzles comprise a first ring of nozzles extending, at least initially, radially outward from the flare stack, and the sliding sleeve is a cylindrical sleeve disposed within the flare stack for movement past the first ring of nozzles.

8. The flare stack of claim 7 in which the nozzles comprise a second ring of nozzles extending, at least initially, radially outward from the flare stack, and the second ring of nozzles is axially offset from the first ring of nozzles, the sliding sleeve being operable for movement past the second ring of nozzles.

9. The flare stack of claim 8 in which the nozzles terminate at a plane perpendicular to the axis of the flare stack.

10. The flare stack of claim 3 in which the nozzles terminate at a plane perpendicular to the axis of the flare stack.

11. The flare stack of claim 5 in which the nozzles are disposed sufficiently close to each other that gas exiting any nozzle tends to draw in and merge with gas exiting from any adjacent nozzle.

* * * * *